US005251402A

United States Patent [19]

Richardson et al.

[11] Patent Number: 5,251,402

[45] Date of Patent: Oct. 12, 1993

[54] SELF RETURN MECHANISM

[75] Inventors: Richard J. Richardson, Simi Valley; Charles E. Crown, San Fernando, both of Calif.

[73] Assignee: Anthony's Manufacturing Company, Inc., San Fernando, Calif.

[21] Appl. No.: 848,203

[22] Filed: Mar. 10, 1992

[51] Int. Cl.[5] ..... E05D 15/06

[52] U.S. Cl. ..... 49/404; 16/49; 16/74; 49/506

[58] Field of Search ..... 49/404, 386, 506; 16/74, 49

[56] References Cited

U.S. PATENT DOCUMENTS

| | | | |
|---|---|---|---|
| 36,647 | 10/1962 | Gilfillan . | |
| 172,887 | 2/1976 | Miller . | |
| 200,107 | 2/1978 | Threlfall . | |
| 350,535 | 10/1986 | Hicks . | |
| 400,041 | 3/1889 | Bender et al. | 16/74 |
| 1,010,071 | 11/1911 | Potter . | |
| 1,524,765 | 2/1925 | Van Arnhem . | |
| 3,837,119 | 9/1974 | Conneally et al. . | |
| 3,928,889 | 12/1975 | Wartian | 16/74 |
| 3,978,617 | 9/1976 | Eventoff . | |
| 4,301,623 | 11/1981 | Demukai . | |
| 4,641,461 | 2/1987 | Niekrasz et al. . | |
| 4,891,911 | 1/1990 | Yung . | |

*Primary Examiner*—Philip C. Kannan

*Attorney, Agent, or Firm*—Poms, Smith, Lande & Rose

[57] ABSTRACT

A self return mechanism for automatically closing or opening a closure, preferably having a movable door supported during movement by a door frame, the door having a braking element mounted to the top edge of the door, and a door return element. The door return element has one end coupled to the door frame structure and its other end coupled to the door and has an intermediate segment oriented to pass through the braking element and around a portion of the grooved circumference of a pulley wheel. The door return element is preferably an elastic element having an outer dimension that changes as the door moves from an opened position to a closed position. The self return mechanism controls the acceleration and deceleration of the door as it is automatically closed, returns the sliding door to its closed position when it is opened only partially, allows for easy removal and replacement of the door from the door frame structure and is inexpensive to manufacture and simple to assemble.

23 Claims, 4 Drawing Sheets

FIG. 1
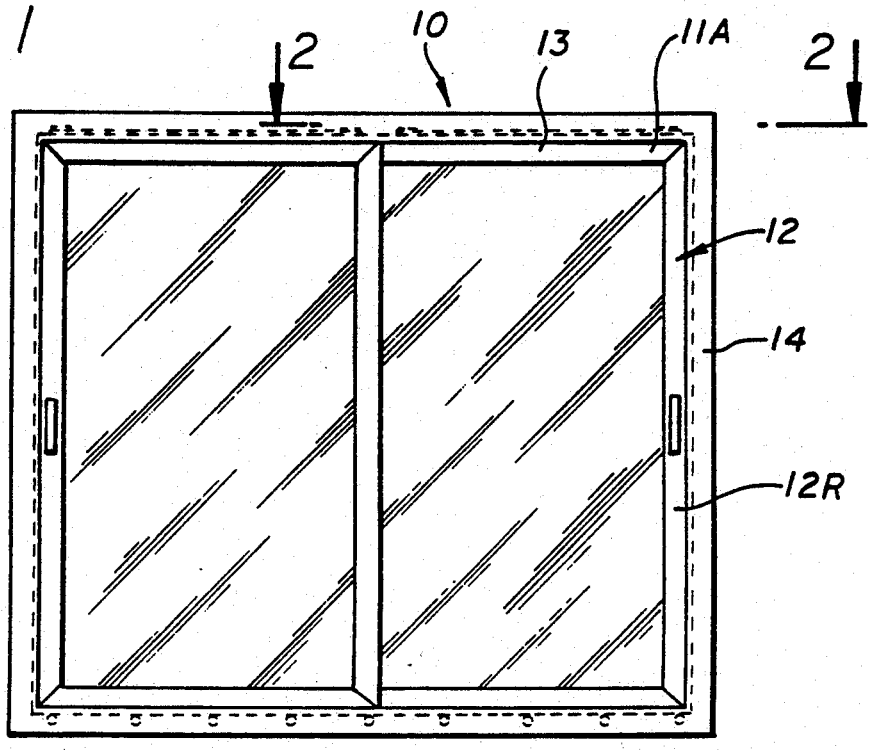
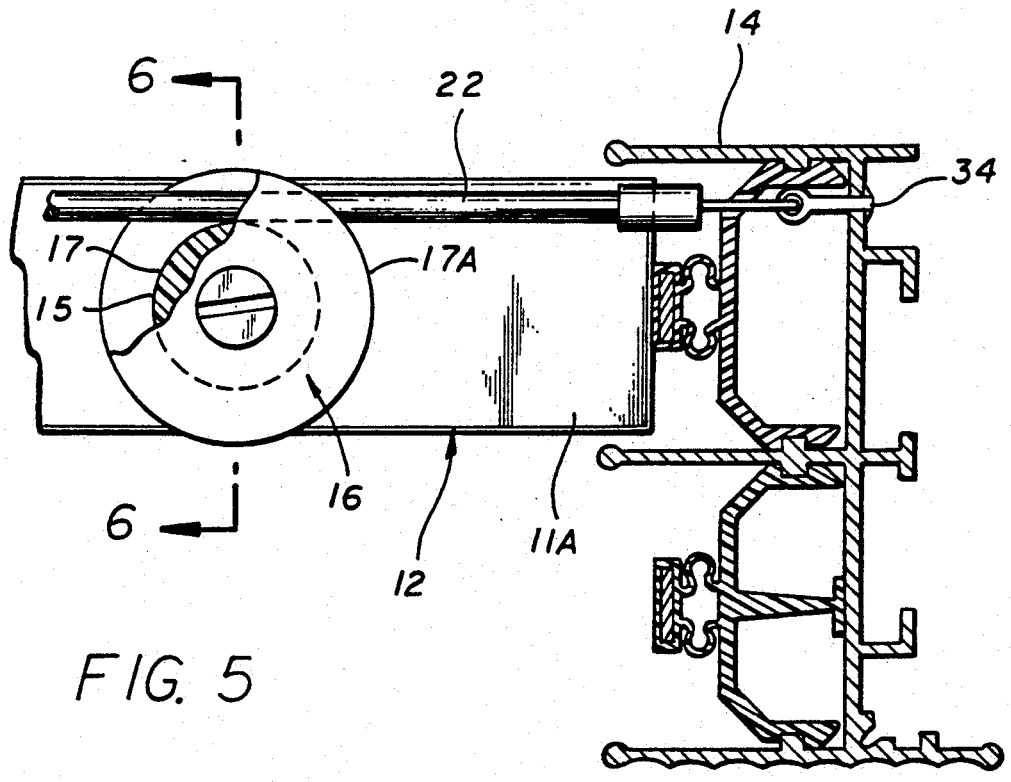
FIG. 5

SELF RETURN MECHANISM

FIELD OF THE INVENTION

The present invention relates in general to closures and more particularly to a return mechanism for automatically returning a closure to a given position. The invention is applicable to closing doors, especially the return of sliding doors to a closed position.

BACKGROUND OF THE INVENTION

Often a door or other closure may be left open unintentionally after use, such as a refrigerator door, or a door may be left closed unintentionally, such as a door over a ventilator opening. It may be costly or undesirable for many types of closures to remain open after use, and it is, therefore, desirable to provide a mechanism for automatically closing the opened door or opening the closed door. Such closures include sliding doors as in a patio door or a commercial refrigerator door, hatches, stereo cabinets, swing doors, sash windows, or any closure movable from either an open position to a closed position or vice versa.

One type of closure for which a self return mechanism is particularly desirable is a sliding door often used for commercial refrigerator and refrigerated display cases. Commercial refrigerators and refrigerated display cases are employed in markets, food-vending operations and the like for the simultaneous preservation of freshness and attractive display of foodstuffs to the customer. Typically, commercial display cases have frames around an opening in a display case with tracks for supporting and guiding large sliding doors which incorporate large areas of multiple layered glazing to permit the customer to see, select and access the refrigerated product easily, while preventing a heat loss into the refrigerated space.

The customer may view the foodsruff in the refrigerator which they wish to purchase, open the sliding door to the refrigerated area, and remove the foodstuff the customer wishes to purchase. Occasionally, the customer may forget to close the sliding door to the refrigerated area. When the sliding door is left open, large amounts of heat are let into the refrigerated section, possibly leading to the spoilage of the foodstuffs while reducing the efficiency of the refrigerator and wasting valuable energy in maintaining the coolness of the refrigerated section. Often, a refrigerated section door that is not closed may remain open for a relatively long period of time if business is slow and employees of the store do not find the opened door.

Assemblies for automatically closing a sliding door are well-known in the art. However, automatically returnable sliding doors have design characteristics that can be improved. For instance, conventional sliding door return assemblies return the door at a relatively constant acceleration causing the door to slam shut and possibly not close completely. Further, if the door is opened only partially, the return force developed in the return assembly may not be sufficient to return the door to its fully closed position. The sliding door return assemblies further may be so complex that the sliding door is difficult to remove from its frame structure for service, which makes cleaning of the space between the door and the door frame structure more difficult. In commercial refrigerators and refrigerated display cases, this space must be cleaned on a regular basis to provide an efficient and sanitary unit as well as a clean appearance for customers and inspectors.

Accordingly, a principal object of the present invention is to provide a self return mechanism for a closure which controls the return of the closure from a first position to a second position.

A further object of the present invention is to provide a door return which varies the acceleration and deceleration or rate of return of the door as it is automatically closed, to prevent the door from slamming into the door frame and not closing fully, to fully close the door regardless of how far the door has been opened, and to improve the safety of the door.

Another object of the present invention is to provide a self return mechanism where the rate of return of the door is subtly controlled by the use of a closing mechanism which provides a force capable of decreasing the rate of return of the door when it is automatically closed from its opened position without slamming the door into the door frame and which provides a force sufficient to close the door even when it is opened only partially.

A further object of the present invention is to provide a self return mechanism using varying frictional interaction between a portion of an elastic element and a braking element through which the elastic element passes to vary the rate of return of the door. This interaction could occur, for example, between a latex cord or tube elastic element and a grooved wheel whereby stretching and relaxing of the elastic element varies the frictional interaction between the elastic element and the wheel.

Another object of the present invention is to provide a slider door return system which allows for easy removal and replacement of the door from the door frame structure.

It is yet another object of the present invention to provide a slider door return system which is inexpensive to manufacture and simple to assemble.

It is yet a further object of one embodiment of the present invention to provide a slider door return system having the objects stated above for slanted sliding doors.

SUMMARY OF THE INVENTION

In accordance with the present invention, a self return mechanism is provided which controls the acceleration and deceleration of a closure as it is automatically returned to a starting position, is capable of fully returning a closure when it is only partially moved from the starting position, is easy to remove and replace from its support structure, and is inexpensive and easy to assemble. The foregoing objectives are achieved through a movable closure having a fixed element defining a passageway, the fixed element preferably being mounted to the closure, and a closure return element. The closure return element has an intermediate segment oriented to pass through the passageway of the fixed element. Preferably, the intermediate segment has an outside dimension that changes as the closure moves from a first position to a second position.

In one preferred embodiment of a self return mechanism for a closure, a sliding door is provided which is movable from an opened position to a closed position within a door frame structure. The sliding door may be vertical or slanted with respect to a vertical plane. A rotatable braking wheel is mounted close to the right hand corner, on a right hand door, on the top horizontal rail of the door. The braking wheel has a grooved circumference. An elastic element is releasably coupled to the door frame and to the top rail of the door so that it horizontally engages the grooved circumference of the braking wheel. The elastic element has an outer dimension that decreases as the elastic element is stretched and that increases as the elastic element is relaxed. The elastic element may be a hollow tubing or a solid cord and preferably may be made of latex or any material that has good memory with similar frictional characteristics to those of latex. The elastic element preferably is not sensitive to temperature extremes.

In a further preferred embodiment, a second rotatable pulley wheel is preferably mounted close to the left hand corner, on a right hand door, on the top horizontal rail of the door. The pulley wheel also has a grooved circumference. The elastic element frictionally engages the pulley wheel around the grooved circumference of the pulley wheel. The pulley wheel allows the elastic element to double back on itself so that the elastic element extends from the door frame through the grooved circumference of the braking wheel, and around the grooved circumference of the pulley wheel to an adjustment block mounted to the top horizontal rail of the door. The adjustment block has a plurality of coupling areas for coupling the end of the elastic element at different points to vary the length of the elastic element that is doubled back on itself.

By doubling back on itself, the elastic element can stretch over approximately one full width of the door, around the pulley, and then can preferably stretch back over approximately ninety percent of the width of the door. The doubling back of the elastic element provides twice the acceleration and deceleration force from the elastic element so that the elastic element can close the door even when it is opened only partially, i.e. one inch or less. Further, the doubling of the acceleration and deceleration by doubling back the elastic element on itself allows for optimum use of the elastic characteristics of the element and for more leeway in selection of other parameters such as the strength of the elastic element.

When the door is released from its opened position, the elastic element tends to relax, thus forcing the door to the closed position. The acceleration and deceleration of the door is controlled as it moves to its closed position due to the outer dimension of the elastic element increasing, thereby increasing the frictional surface area of contact of the elastic element with the grooved circumference of the braking wheel. The doubling back of the elastic element around the pulley wheel provides significant tension in the elastic element even when the door is closed so that the tension is sufficient to force the door to its closed position even when the door is opened only slightly. The controlled acceleration and deceleration of the closing door allows it to automatically close without the door slamming against the frame or leaving it slightly open.

In another preferred embodiment, a slanted sliding door is provided. When the sliding door is slanted, the outer circumference of the pulley wheel will preferably contact the door frame structure. In this embodiment, the elastic element preferably crosses over itself before engaging the grooved circumference of the pulley wheel and passes around the pulley wheel, thereby causing the pulley wheel to rotate in a direction opposite the rotation that otherwise would have been caused by the movement of the door when moving to its closed position. Friction is thereby created between the pulley wheel and the door frame structure causing further deceleration of the door as the tension in the elastic element forces the door to its closed position.

The present self return mechanism uses varying frictional interaction between a portion of an elastic element and a braking element through which the elastic element passes to vary the rate of return of the door. This configuration of the self return mechanism allows for easy removal and replacement of the door from the door frame structure by disconnecting the elastic element from the door frame structure and is inexpensive and simple to manufacture.

Other objects, features, and advantages of the invention will become apparent from a consideration of the following detailed description and from the accompanying drawings.

BRIEF DESCRIPTION OF THE DRAWINGS

FIG. 1 is a front elevation view of sliding doors with which one embodiment of the present invention can be used;

FIG. 5 is an enlarged cross sectional view of the section identified by the circle 5 in FIG. 2 showing the door in its closed position.

DETAILED DESCRIPTION OF THE PREFERRED EMBODIMENTS

Figure 2:
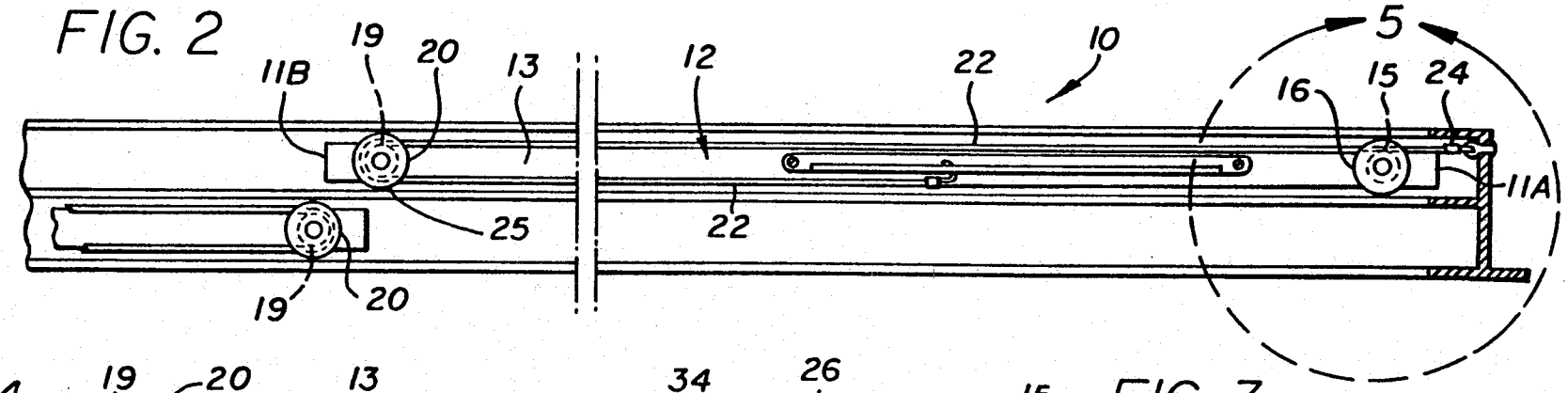
FIG. 2 is a top plan view and partial cross section taken along the line 2—2 in FIG. 1 showing a door return according to the present invention and showing the sliding doors in their closed position.

The present invention is embodied in a self return mechanism that controls the acceleration and deceleration of a closure such as a door as it is automatically returned to a starting position, that can return a sliding door, for example, to its fully closed position when it is opened only partially, that allows for easy removal and replacement of the door from the door frame structure and that is inexpensive to manufacture and simple to assemble. The self return mechanism is suited for any type of closure such as sliding doors for patios, hatches, swing doors, stereo cabinets, sash windows, or any enclosure adapted for counterbalance systems where the closure is moved from a closed position to an opened position or from an opened position to a closed position.

In the particular embodiment shown in the drawings and herein described, the self return mechanism 10 (see FIGS. 1 and 2) is particularly suited for a movable closure or slider door 12 supported during movement by a stationary support structure such as door frame structure 14. The door frame structure 14 is set in a case forming part of the refrigerated section of a supermarket or the like. The door frame structure 14 is of a size to support a pair of doors which are situated in a pair of tracks, side-by-side, for allowing movement of both doors, as is well known to those skilled in the art. The doors are preferably any glass door for refrigeration applications. Representative dimensions of several sliding doors include 30 inches by 63 inches for what will be termed herein for purposes of identification only as a small-sized door, to 63 inches by 60 inches for a medium-sized door and 72 inches by 36 inches for a large-sized door. These dimensions may be larger or smaller depending on the application.

Figure 3:
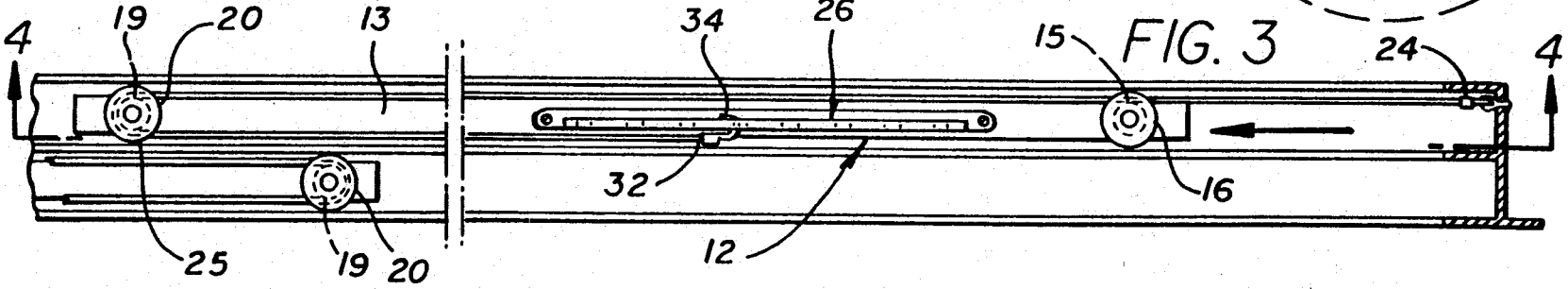
FIG. 3 is a top plan and partial cross sectional view similar to FIG. 2 showing the sliding door in an open position.
Figure 4:
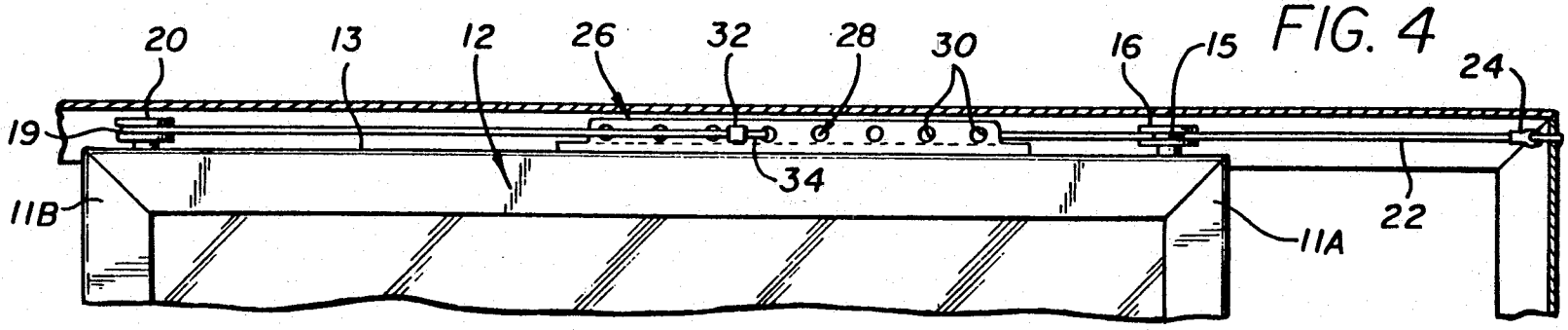
FIG. 4 is a front plan and partial cross sectional view taken along the line 4—4 in FIG. 3 showing the sliding door in an open position.
Figure 6A:
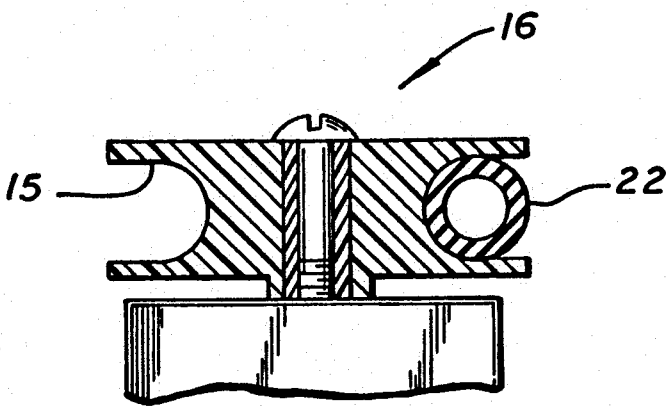
FIG. 6A is a transverse cross-sectional view similar to that of FIG. 6 showing a hollow elastic element engaged in the braking wheel.
Figure 6:
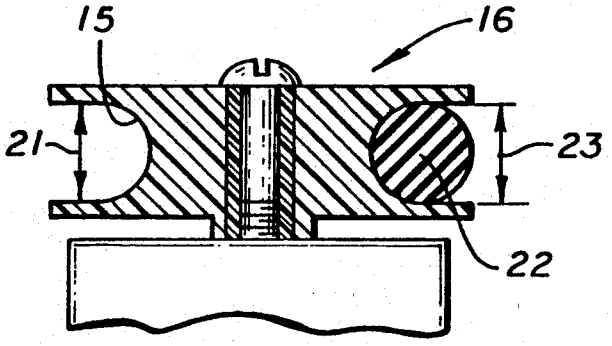
FIG. 6 is a transverse cross sectional view taken along the line 6—6 in FIG. 5 showing the elastic element engaged in the braking wheel.

The self return mechanism 10 has a fixed element preferably mounted on the door to define a restriction forming part of the apparatus for controlling the return of the door. The fixed element is preferably in the form of a braking wheel 16 freely rotatable about a spindle close to the right hand corner 11A on a right hand door 12R on the top horizontal rail 13 of the door. (FIGS. 2, 3, and 4). In this embodiment where the fixed element is in the form of a braking wheel, the restriction in the braking wheel is formed by a passageway defined by a grooved circumference 15 having a first diameter 17 and an outer circumference 17A having a second diameter greater than the first defining the depth of the groove (FIG. 5). The wheel 16 is termed a braking wheel as it serves to decelerate the door as it is pulled to the closed position by an elastic element 22. The braking wheel 16 is preferably constructed of a high density plastic with a bearing in its center such as a ball bearing or bearing sleeve. The plastic may be nylon or a similar material. The groove 15 of the braking wheel 16 has a semi-circular shape in transverse cross section (FIG. 6), and may have a diameter or gap 21 of preferably 5/32 inch for the small-sized door, 3/16 inch for the medium-sized door, and ¼ inch for the large-sized door referenced above. The second or outside diameter of the drive wheel is preferably 29/32 inch for the small-sized door, 31/32 inch for the medium-sized door, and 1 and 9/16 inch for the large-sized door. These dimensions may be larger or smaller depending on the application.

A pulley wheel 20 is also preferably mounted to the left hand corner 11B on a right hand door 12R on the top horizontal rail 13 of the door 12. The pulley wheel 20 also has a grooved circumference 19. The size of the pulley wheel 20 is preferably identical to that of the braking wheel for each size of door 12. (FIGS. 2, 3, 4 and 5).

The self return mechanism 10 further includes a closure return element or elastic element 22 for moving the door from a first position, such as the open position in a refrigerator door, to a second position, such as the closed position, and for engaging the grooved circumference in the braking wheel, such that a dimension of the elastic element changes as the door moves from the open position to the closed position. As will be discussed below, the change in the dimension of the elastic element coacts with the grooved circumference of the braking wheel to control the movement of the door. The elastic element has a fixed end 24 releasably coupled to the door frame structure 14 to anchor the elastic element preferably at the same vertical level as the pulley and braking wheels. The elastic element 22 is oriented to pass through the grooved circumference 15 of the braking wheel 16 and around the grooved circumference 19 of the pulley wheel 20 to double back on itself to provide the return force necessary to close the door when the door is released from any open position, whether fully or only partially open. The elastic element 22 is preferably doubled back on itself to provide a greater length in the element, and, likewise, to give a greater range of tension settings using the adjustment block 26. By doubling back the elastic element, or otherwise effectively adding more elastic material without changing the spring constant of the elastic element, the return force on the door can be adjusted or varied over a more defined range. The force on the door using a doubled back elastic element can be effectively increased without changing the spring constant of the material. Moreover, because the range of movement of the door is limited, the full elastic stretch of the elastic element is not used. Doubling back of the elastic element permits greater use of the stretch capabilities of the element. The other fixed end of the elastic element is releasably coupled to an adjustment block 26 so that the tension under which the elastic element is placed can be adjusted to suit the circumstances. (FIGS. 2, 3 and 4).

The elastic element 22 preferably extends over approximately the entire width of the door 12 and then doubles back around the pulley wheel 20 over approximately ninety percent of the width of the door 12. By doubling the elastic element 22 back on itself, the amount of force on the door from the elastic element can be doubled from the amount of force in an embodiment where the elastic element 22 does not double back on itself. (While FIG. 4 shows the elastic element doubling back an amount less than 90%, this is done for purposes of clarity to show the adjustment block, described more fully below.)

Figure 7:
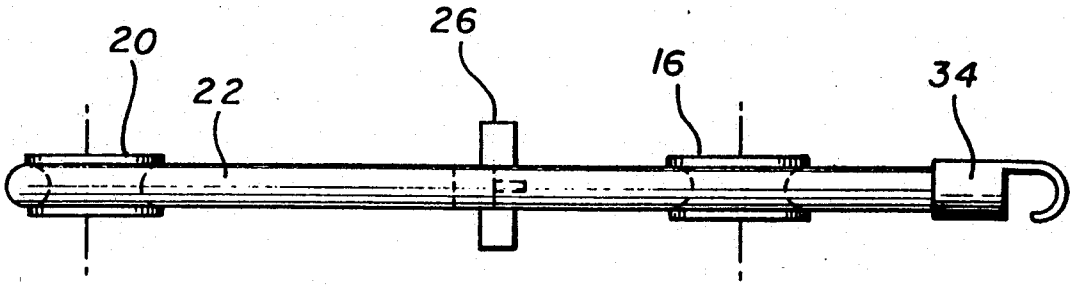
FIG. 7 is a schematic and side elevation view of the door return according to the present invention in a relaxed condition.
Figure 8:
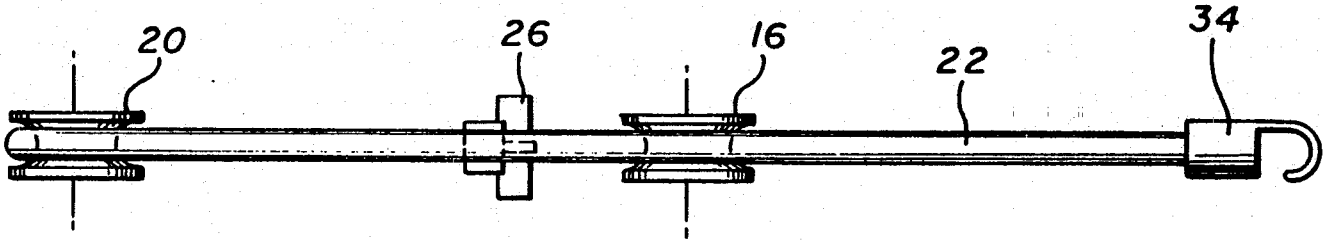
FIG. 8 is a schematic and side elevation view of a door return in a stretched or stressed condition, such as where a door is in a half-open position.
Figure 9:
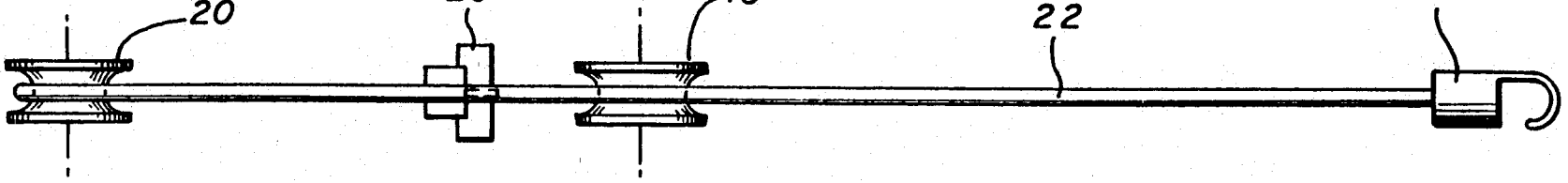
FIG. 9 is a schematic and side elevation view of a door return mechanism similar to FIGS. 7 and 8 showing the door return in a further stretched condition, such as when a door is in a full open position.

The elastic element 22 has an outer dimension 23 that decreases as the elastic element is stretched (see FIGS. 7–9) and that increases as the elastic element is relaxed. The elastic element 22 may be made of a hollow tubing (FIG. 6A) or a solid cord (FIG. 6) and may be made of latex or any other elastic material, and preferably a material that can decrease its outer dimension 23 as it is stretched and increase its outer dimension 23 as it is relaxed from the stretched condition. The elastic element 22 may be any material that has good memory for example with similar frictional characteristics to those of latex and, in the preferred embodiment is not sensitive to temperature extremes. The use of an elastic element of this type eliminates the need to use a metallic spring, which may tend to bend unelastically when engaged around the grooved circumference of the pulley wheel and which does not have good frictional characteristics. The outer dimension 23 of the relaxed elastic element 22 (FIG. 7) is preferably equal to the diameter 21 or gap dimension of the grooved circumference 15 of the braking wheel 16 when the elastic element is properly tensioned with the door closed. The length of the relaxed elastic element 22 is proportional to the weight of the sliding door 12.

The self-return mechanism is capable of controlling the door's rate of return to its closed position by varying the frictional interaction between a portion of the elastic element 22 and the grooved circumference 15 of the braking wheel 16. This frictional interaction is obtained by the frictional engagement of that portion of the elastic element engaging the braking wheel with the grooved circumference of the braking wheel 16. Thus, as the door 12 is moved to its opened position, the elastic element 22 is stretched, causing its outer dimension 23 to decrease, thus decreasing the frictional surface area of contact of the elastic element 22 with the grooved circumference 15 of the braking wheel 16 and thereby decreasing the force necessary to move the door 12 to its open position against the tension of the elastic element below that which would be necessary without the frictional engagement.

When the door 12 is released from its opened position, the elastic element 22 tends to relax, providing sufficient tension to force the door to its closed position. The acceleration and deceleration of the door 12 is controlled as it moves to its closed position due to the increase in the outer dimension 23 of the elastic element 22, thereby increasing the frictional surface area of contact of the elastic element with the grooved circumference 15 of the braking wheel 16. In this manner, the changing dimension of the elastic element coacts with the restriction formed by the dimensions of the grooved wheel to control the return of the door. The wall of the track in which the door travels prevents the elastic element from leaving the groove if the elastic tends to migrate out of the groove.

The adjustment block 26 is preferably mounted to the top horizontal rail 13 of the door 12 between the drive wheel 16 and the wheel 20. The adjustment block 26 may have a plurality of coupling areas 28 such as holes 30 for releasably coupling the fixed end 32 of the elastic element to the adjustment block to vary the amount of tension in the elastic element 22. The elastic element 22 has coupling means such as a hook fixed to each end 24 and 32 for coupling the elastic element to the coupling areas formed into the adjustment block 26 and an eyelet socket 34 mounted to the door frame structure 14 for coupling to the door frame structure. (FIGS. 2, 3, 4 and 5). This configuration for coupling the ends of the elastic element also provides for easy removal and assembly of the door for easy cleaning of the area between the door and the door frame structure.

The coupling areas 28 of the adjustment block 26 may be used to vary the tension in the elastic element 22. If the tension in the elastic element is increased, the return force on the door will be likewise increased. Further, by doubling the elastic element 22 back around the pulley wheel back toward its connection at the door frame structure there will be more leeway in adjusting the tension of the elastic element 22. This doubling back of the elastic element 22 allows for a higher return force to be placed on the door 12 which enables a partially opened door (e.g. opened approximately one inch) to be forced shut. The configuration of the elastic element 22 passing through the grooved circumference 15 of the braking wheel 16 also adds frictional engagement for the elastic element with the braking wheel. Thus, even though the return force of the elastic element 22 is higher with a more highly tensioned element, there is still sufficient braking for the door 12 as it nears its closed position to slow it down so that it will close firmly but will not strike the door frame structure 14 with a great enough force to leave the door slightly ajar. However, even with this control, there is still a sufficiently high tension in the elastic element 22 to fully close a partially opened door.

Figure 2A:
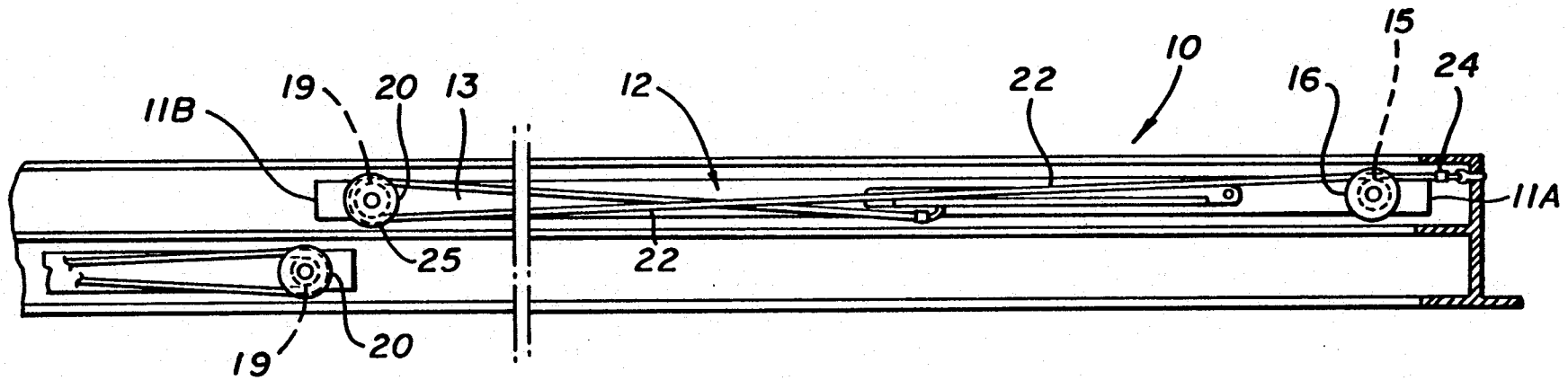
FIG. 2A is a top plan view and partial cross-section similar to FIG. 2 showing a door return having a cross-over configuration.

In another preferred embodiment, a slanted sliding door is provided. To provide a greater frictional surface area of contact, the outer circumference 25 of the pulley wheel 16 is in frictional contact with an upper track in the door frame structure 14 and the elastic element 22 is crossed over itself before engaging with the grooved circumference 19 of the pulley wheel 20 and around the pulley wheel 20 (FIG. 2A). When the slanted sliding door is moving to its closed position, the pulley wheel 20 rotates in a direction opposite to the movement of the door since the elastic element 22 is crossed over itself. This rotation of the pulley wheel 20 creates friction between the outer circumference 25 of the pulley wheel 20 and the door frame structure 12. The tension of the elastic element 22 is still sufficient to fully close the slanted door regardless of how far it is opened. Further, the tension and frictional characteristics of the elastic element 22 are sufficient to fully close the slanted door at a rate which will prevent slamming the slanted door against the door frame structure 14. Therefore, there preferably is always sufficient tension in the elastic element 22 to fully close the slanted door and leave it closed, even when the slanted door is pushed open only slightly. Moreover, the frictional engagement between the braking wheel 16 and that portion of the elastic element that comes in contact with it preferably increases as the slanted door moves to a closed position, while never reaching the point where the door is stopped by any such frictional engagement.

While a particular form of the invention has been illustrated and described, it will be apparent that various modifications can be made without departing from the scope of the invention. For instance, the elastic element 22 may have a tapered outer diameter for further control of the acceleration and deceleration of the door as it closes. Thus, as the door reaches its closed position the position of the elastic element engaged to the braking wheel has an even larger increase in its outer diameter than would a non-tapered elastic element thereby further slowing the door as it reaches its closed position. Additionally, the grooved circumference of the braking wheel may be tapered or V-shaped to add further friction to the elastic element and further slow the door as it moves to its closed position and the elastic element may have the cross section of a V-belt. Also, the braking wheel 16 may be replaced with an orifice through which the elastic element 22 passes. Further, the elastic element may have a solid bulge or the like to quickly decelerate the door at a critical time as the door is closing or at a critical position, such as when the door approaches the frame, as the bulge would be wider than the orifice or other restriction. Accordingly, it is not intended that the invention be limited by the specific embodiment disclosed in the drawings and described in detail hereinabove.

We claim:

1. A self-return mechanism, comprising:

a support structure defining an opening;

a movable closure supported during movement by the support structure to permit the closure to move between a plurality of positions, including a closed position to close the opening;

an element mounted on the closure and defining a passageway so as to be aligned in a given direction; and a closure return element for moving the closure from a first position to a second position, having a first portion coupled to the support structure and a second portion coupled to the closure and having an intermediate segment having an outer dimension and oriented to pass through the passageway of the fixed element as the closure moves from a first position to a second position such that the fixed element remains aligned as the closure moves from the first position to the second position, wherein the outer dimension of the segment passing through the passageway changes as the closure moves from the first position to the second position.

2. The self return mechanism of claim 1 wherein the closure is a door and wherein the first position is an opened position and the second position is a closed position.

3. The self return mechanism of claim 2 wherein the closure return element is a hollow tubing that has an outer dimension that decreases as the closure return element is stretched and that increases as the closure return element is relaxed from a stretched condition.

4. The self return mechanism of claim 2 wherein the closure return element is a solid tubing that has an outer dimension that decreases as the closure return element is stretched and that increases as the closure return element is relaxed from its stretched condition.

5. The self return mechanism of claim 2 wherein the closure return element is a latex tubing that has an outer dimension that decreases as the closure return element is stretched and that increases as the closure return element is relaxed from its stretched condition.

6. The self return mechanism of claim 2 further comprising an adjustment block mounted on the closure and having a plurality of coupling areas for coupling the second end of the closure return element.

7. The self-return mechanism of claim 1 wherein the element defining the passageway includes a rotatable grooved pulley mounted to the closure and wherein the passageway includes a dimension approximating the outer dimension of the return element when the closure is closed.

8. The self-return mechanism of claim 7 wherein the pulley is positioned adjacent one end of the door and wherein the return element extends substantially straight through the passageway relative to the pulley.

9. The self-return mechanism of claim 7 further including a second pulley spaced from the first pulley and wherein the return element extends from the first pulley to and around a portion of the second pulley and an attachment element between the first and second pulleys for the second end of the return element.

10. The self-return mechanism of claim 9 further comprising an attachment element on the closure to which the second end of the return element is coupled.

11. The self-return mechanism of claim 7 wherein the grove of the pulley has a depth and wherein the return element has a relaxed condition with a first dimension and the first dimension of the relaxed return element is less than the depth of the groove.

12. The self-return mechanism of claim 1 wherein the passageway has a first dimension and wherein the return element has relaxed dimension when the closure is closed wherein the relaxed dimension is approximately the same as the first dimension.

13. A self-return mechanism, comprising:

a stationary support structure defining an opening;

a movable door supported during movement by the support structure to permit the closure to move between a plurality of positions, including a closed position to close the opening;

a fixed element mounted on the door and defining a passageway;

a rotatable pulley wheel mounted on the door and having a grooved circumference; and a closure return element for moving the door from an opened position to a closed position, having a first portion coupled to the support structure and having an intermediate segment having an outer dimension and oriented to pass through the passageway of the fixed element and oriented to pass around a portion of the grooved circumference of the pulley wheel as the door moves from an opened position to a closed position, the second end of the closure return element being coupled to the door between the fixed element and the pulley wheel, wherein the outer dimension of the segment passing through the passageway changes as the door moves from the opened position to the closed position.

14. The self return mechanism of claim 13 wherein the intermediate segment of the closure return element crosses over itself and around a portion of the grooved circumference of the pulley wheel.

15. A slider door return system comprising:

a sliding door having first and second ends and having an edge;

a frame structure for slidably guiding the door between an opened position and a closed position of the door;

a rotatable braking wheel mounted to the first end of the door at its edge and having a grooved circumference;

a rotatable pulley wheel mounted to the second end of the door at its edge and having a grooved circumference;

an adjustment block having a plurality of coupling areas, the adjustment block being mounted to the door between the braking wheel and the pulley wheel; and an elastic element having a first end and second end, the first end of the elastic element being coupled to the frame structure at the portion of the frame structure near the braking wheel, the elastic element engaging the grooved circumference of the braking wheel and passing around and engaging the grooved circumference of the pulley wheel, and the second end of the elastic element being coupled to one of the coupling areas on the adjustment block, the elastic element having an outer dimension that decreases as the elastic element is stretched and that increases as the elastic element is relaxed;

wherein when the door is guided from the closed position to the opened position, the elastic element is stretched, and, when the door is released in the opened position, the elastic element is relaxed, the acceleration of the door varying as the outer dimension of the elastic element increases.

16. A slider door return system for slanted doors comprising:

a slanted sliding door having an edge;

a door frame structure;

a rotatable braking wheel mounted to the edge of the door and having a grooved circumference and an outer circumference; and an elastic element having a first end and a second end, the first end of the elastic element being coupled to the frame structure, the elastic element engaging the grooved circumference of the braking wheel, and the second end of the elastic element being coupled to the edge of the door, the elastic element having an outer dimension that decreases as the elastic element is stretched and that increases as the elastic element is relaxed;

wherein when the door is guided from the closed position to the opened position, the elastic element is stretched, and, when the door is released in the opened position, the elastic element is relaxed, forcing the door to the closed position, the acceleration of the door varying as the outer dimension of the elastic element increases.

17. The slider door return system for slanted doors of claim 16 further including an adjustment block mounted to the edge of the door, the adjustment block having a plurality of coupling areas for coupling the second end of the elastic element.

18. The slider door return system for slanted doors of claim 16 further including a rotatable pulley wheel on the door having a grooved circumference so that the elastic element is engaged around the grooved circumference of the pulley wheel, the pulley wheel having an outer circumference in frictional contact with the door frame structure wherein the second end of the closure return element is coupled to the door between the braking wheel and the pulley wheel.

19. The slider door return system for slanted doors of claim 18 wherein the elastic element crosses over itself and engages the grooved circumference of the pulley wheel so that the pulley wheel rotates in a first direction when the door is guided to its open position and rotates in a second direction when the door is forced to its closed position.

20. A method for returning sliding doors comprising:

opening a sliding door;

forcing the sliding door to its closed position by:

relaxing an elastic element coupled at its first end to the frame structure of the sliding door, the elastic element engaging the grooved circumference of a rotatable braking wheel mounted on the edge of the sliding door, the elastic element being coupled at its second end to one of a plurality of coupling areas on an adjustment block mounted to the edge of the sliding door; and varying the acceleration of the sliding door by increasing the frictional surface area of contact of the elastic element within the grooved circumference of the braking wheel by providing an elastic element that has an outer dimension that decreases when the elastic element is stretched and has an outer dimension that increases when the elastic element is relaxed.

21. The method for returning sliding doors of claim 20 wherein a rotatable pulley wheel mounted to the sliding door is provided wherein the elastic element is engaged around the grooved circumference of the pulley wheel and the second end of the elastic element is coupled to the adjustment block between the braking wheel and the pulley wheel and wherein the step of relaxing an elastic element includes the step of allowing the relaxing elastic element to pass around the grooved circumference of the rotatable pulley wheel as the dimension of the elastic element changes between the second end and the first end.

22. The method for returning sliding doors of claim 21 wherein the elastic element is crossed over itself and engaged to the grooved circumference of the pulley wheel, and wherein the step of relaxing the elastic element includes the step of rotating the rotatable pulley wheel with the elastic element as the elastic element relaxes.

23. A method for returning slanted sliding doors comprising:

opening a slanted sliding door;

forcing the slanted sliding door to its closed position by:

relaxing an elastic element, coupled at its first end to the door frame structure and extending within a portion of the grooved circumference of a braking wheel, the elastic element crossing over itself and being engaged around the grooved circumference of a rotatable pulley wheel mounted to the sliding door, the elastic element being coupled at its second end to an adjustment block mounted to the sliding door between the braking wheel and the pulley wheel; and varying the acceleration of the sliding door by increasing the frictional surface area of contact of the elastic element with the braking wheel by providing an elastic element that has an outer dimension that decreases when the elastic element is stretched and has an outer dimension that increases when the elastic element is relaxed and wherein the pulley wheel has an outer circumference in frictional contact with the door frame structure and rotates in a direction to create friction between the outer circumference of the pulley wheel and the door frame structure in a direction against the movement of the closing door.

* * * * *